US006505455B1

(12) United States Patent
Georgeau

(10) Patent No.: US 6,505,455 B1
(45) **Date of Patent: *Jan. 14, 2003**

(54) STRUCTURAL TERMINATION SYSTEM

(75) Inventor: Philip C. Georgeau, Kalamazoo, MI (US)

(73) Assignee: Chem Link, Inc., Kalamazoo, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/330,107

(22) Filed: Jun. 10, 1999

Related U.S. Application Data

(63) Continuation-in-part of application No. 09/095,441, filed on Jun. 10, 1998.

(51) Int. Cl.[7] ..... F04B 7/02

(52) U.S. Cl. ..... 52/746.11; 52/94; 52/96; 52/97; 52/58; 52/732.1

(58) Field of Search ..... 52/62, 59, 58, 52/94, 96, 97, 732.1, 746.1, 745.21

(56) References Cited

U.S. PATENT DOCUMENTS

| | | | | | |
|---|---|---|---|---|---|
| 1,710,484 | A | * | 4/1929 | Luther | 52/58 |
| 2,857,861 | A | | 10/1958 | Trostle | |
| 3,204,375 | A | * | 9/1965 | Kotarski | 52/94 |
| 3,242,622 | A | | 3/1966 | Snead | |
| 3,432,976 | A | | 3/1969 | Berg | |
| 3,444,658 | A | | 5/1969 | Gobel | |
| 3,469,357 | A | | 9/1969 | Seidler | |
| 3,668,811 | A | | 6/1972 | Pollard | |
| 3,680,269 | A | * | 8/1972 | Fischer, Jr. et al. | 52/94 |
| 3,862,531 | A | | 1/1975 | Attaway et al. | |
| 4,483,112 | A | | 11/1984 | Rueblinger | |
| 4,598,507 | A | | 7/1986 | Hickman | |
| 4,662,129 | A | | 5/1987 | Hickman | |
| 4,686,803 | A | | 8/1987 | Couderc et al. | |
| 4,798,033 | A | | 1/1989 | Weidl | |
| 4,800,689 | A | | 1/1989 | Lane | |
| 5,031,367 | A | | 7/1991 | Butzen | |
| 5,239,791 | A | | 8/1993 | Mills, Jr. et al. | |
| 5,272,846 | A | | 12/1993 | Kelley et al. | |
| 5,605,020 | A | | 2/1997 | Chambers | |

FOREIGN PATENT DOCUMENTS

| | | | | |
|---|---|---|---|---|
| CA | 937021 | | 11/1973 | |
| DE | 2333959 | | 7/1973 | |
| DE | 2233714 | | 1/1974 | |
| DE | 2553134 | | 11/1975 | |
| DE | 2906453 | | 8/1980 | |
| EP | 0090245 | | 3/1983 | |
| GB | 856852 | | 12/1960 | |
| GB | 910393 | | 11/1962 | |
| GB | 1347974 | | 2/1974 | |
| GB | 2084628 | * | 4/1982 | 52/94 |
| JP | 406240829 | | 8/1994 | |
| SE | 212315 | * | 4/1967 | 52/94 |

* cited by examiner

*Primary Examiner*—Lanna Mai
*Assistant Examiner*—Phi Dieu Trana
(74) *Attorney, Agent, or Firm*—Price, Heneveld, Cooper, Dewitt & Litton

(57) ABSTRACT

A structural termination system includes an elongated structural member having a generally horizontal lower web defining a lower surface shaped to fit closely along the upper surface of a building. Moisture curable adhesive is disposed on the lower surface, and extending substantially uninterrupted along the entire length of the structural member to form a seal along the entire structural member when installed on an upper surface of a building.

3 Claims, 3 Drawing Sheets

STRUCTURAL TERMINATION SYSTEM

CROSS-REFERENCES TO RELATED APPLICATIONS

The present Application is a Continuation-In-Part of commonly assigned, co-pending U.S. patent application Ser. No. 09/095,441, filed on Jun. 10, 1998, entitled STRUCTURAL TERMINATION SYSTEM, the entire contents of which is hereby incorporated herein.

BACKGROUND OF THE INVENTION

The present invention relates to a structural termination system for securing a perimeter of a low slope roof layer to an exterior building structure, and in particular to a structural termination system that is adhesively bonded directly to the building structure using a moisture curing adhesive, thereby eliminating the need for a wood block nailer structure.

Low or flat slope roofs are often covered by one or more roof membranes and insulation. The roof membrane may be adhesively bonded to the roof, or may be covered with loose-laid ballast to retain the membrane. Wind may generate substantial uplift forces, which can cause the edge of the roof membrane to peel upwardly, causing substantial damage to the roof structure.

Commercial low slope roofing falls into three distinct classes: (1) bituminous (asphalt based); (2) thermosetting membranes; and (3) thermoplastic membranes. The bituminous roofing systems include built up roofing (BUR) and modified bitumen (rubber modified asphalt). The thermoset membranes are primarily composed of one polymer type, EPDM rubber (ethylene propylene dimer). The thermoplastic roof membranes are primarily composed of "PVC" (polyvinyl chloride).

Roof edge systems must hold two distinctly different construction materials together. These are structural wall components such as masonry and steel, oriented in a vertical plane, and bituminous or elastomeric polymer membranes oriented in a horizontal plane.

Roof materials are subject to stress and strain caused by wind uplift forces, snow and water loads, dimensional change and movement of wall components, and shrinkage of the roofing materials caused by heat, cold, and aging.

Various methods have been developed to secure the edge of the roof membrane and insulation. Available roof edging systems typically include one or more wood block "nailer" strips which are fastened along the upper edge of the wall or roof deck by use of mechanical fasteners, such as large bolts. A wood cant having a triangular cross-sectional shape may be mechanically fastened to the top of the wood nailer to provide a gravel stop for ballasted loose-laid roof systems. The wood block nailer generally has a thickness that is about equal to the insulation covering the roof deck, such that the roof membrane will lie flat across the wood nailer-to-insulation interface. One or more sheet metal flashing members are then secured to the wood nailer and cant by mechanical fasteners, such as screws. The roof membrane fits under the flashing, such that the flashing secures the edge of the membrane. A sheet metal fascia cap is then installed over the flashing. The fascia cap extends downwardly along the outer face to form a drip rail. A continuous cleat strip is then installed in back of the drip rail to secure the drip rail to the nailer structure.

Available edge-securing systems, such as that just described, require a wood block nailer structure to receive the mechanical fasteners that are used to attach the flashing, fascia cap and cleat strip. The wood block nailer structure is then cut to size and installed at the building site. The wood block nailer structure is then secured to the building roof and/or wall, using mechanical fasteners, and the flashing and fascia cap are installed to the wood block nailer structure, also using mechanical fasteners. The need to fit the wood block nailer structure at the installation site, as well as the need to install numerous mechanical fasteners results in an installation procedure having numerous labor-intensive steps.

Furthermore, the sheet metal fascia cap and/or flashing can separate from the nailer structure due to wind loading. This results in substantial damage to the roof structure, and may lead to further damage to the building and items within the building due to water entering the building.

Accordingly, a structural termination system that alleviated the above-mentioned problems was desired.

SUMMARY OF THE INVENTION

One aspect of the present invention is a structural termination system for securing the perimeter of a waterproof roof layer to the upper surface of a building proximate the roof of the building. The structural termination system includes an elongated structural member having a generally horizontal lower web defining a lower surface shaped to fit closely along the upper surface of a building. Moisture curable adhesive is disposed on the lower surface, and extending substantially uninterrupted along the entire length of the structural member to form a seal along the entire structural member when installed on an upper surface of a building.

Another aspect of the present invention is a building structure including a building wall defining an interior space, and a roof extending over the interior space. A waterproof roof layer covers the roof, and defines a perimeter. A one-piece, unitary, elongated structural member extends along the perimeter, and has a tubular construction with a continuous outer perimeter including a bottom web defining a lower surface of the structural member. The lower surface has a contour closely corresponding to an upper surface of the building structure. Adhesive sealingly bonds the perimeter of the roof layer to the elongated structural member, and provides the sole physical connection between the waterproof roof layer and the elongated structural member, without additional fascia members or mechanical fasteners.

Yet another aspect of the present invention is a termination system for securing a waterproof roof layer to a building structure that includes a generally vertical wall and a roof structure. The waterproof roof layer covers the roof structure and defines a side edge proximate an upper edge of the wall. The termination system includes an elongated structural member extending along the side edge of the waterproof roof layer with the waterproof roof layer sealingly secured to the elongated structural member to form a waterproof cover over the building structure. Moisture curable adhesive bonds the structural member to the building structure, such that the side edge of the waterproof roof layer is sealed and secured to the building structure.

Yet another aspect of the present invention is a method of retaining a waterproof roof layer to a building adjacent the perimeter of the building roof. An elongated structural member is provided, and a sheet of facing material is adhesively bonded to the elongated structural member prior to transport to the installation site. The elongated structural member is secured to the building adjacent the perimeter of the roof. A waterproof roof layer is bonded to the sheet of facing material to sealingly secure the waterproof roof layer to the elongated structural member.

These and other features, advantages and objects of the present invention will be further understood and appreciated by those skilled in the art by reference to the following specification, claims and appended drawings.

DETAILED DESCRIPTION OF PREFERRED EMBODIMENTS

Figure 1:
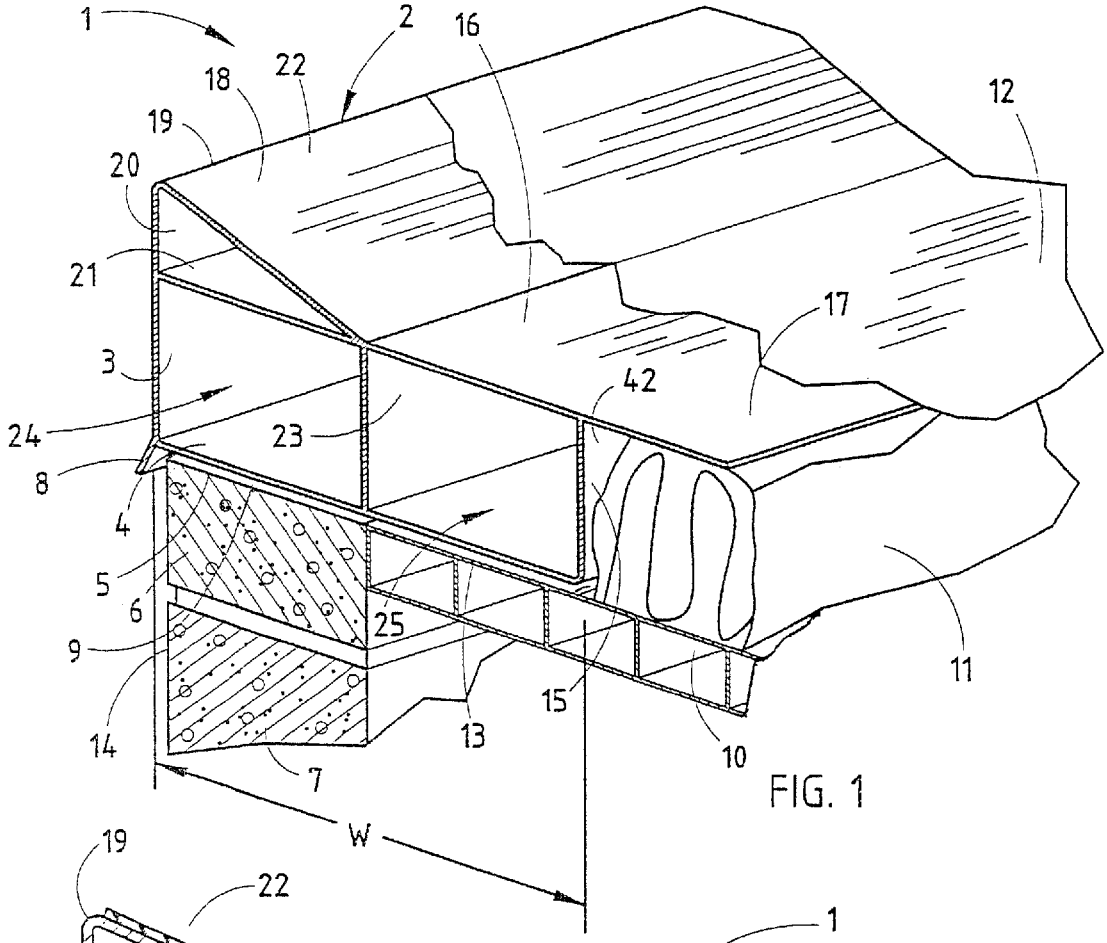
FIG. 1 is a cross-sectional perspective view of the structural termination system.

For purposes of description herein, the terms "upper," "lower," "right," left, "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIGS. 1 and 1A) generally designates a first embodiment of a structural termination system according to the present invention. In the illustrated example, structural termination system 1 includes a one-piece elongated structural member 2 defining an outer wall 3 and a horizontal bottom wall 4 defining a lower surface 5 that has substantially the same contour as an upper surface 6 of an associated building wall 7. The building wall 7 is characterized by the absence of a nailer structure. The structural member 2 further includes a drip edge 8 extending downwardly from the outer wall 3 such that the outer wall 3 and the drip edge 8 cooperate to define an integral fascia. Structural adhesive 9 is disposed on the lower surface 5, and securely bonds the structural member 2 directly to the upper surface 6 of the associated building wall 7 without a nailer structure or mechanical fasteners located along the structural member 2. In a preferred embodiment, the elongated structural member 2 is formed of extruded aluminum. However, it is anticipated that structural member 2 could be fabricated from other materials such as other types of structural metals or polymer materials such as acrylonitrile-butadiene-styrene ("ABS"), polyethylene teraphthalate, ("PET"), or polyvinyl chloride ("PVC") if desired for a particular application.

Flat or low-angle roof systems include a flat structural member such as steel or concrete deck 10 which is supported along the perimeter by the building wall 7. One or more layers of insulation 11 are disposed on the steel deck 10. One or more waterproof roofing layers 12 are disposed on top of the insulation 11, and extend over the structural member 2. In the illustrated example, the structural member 2 is bonded directly to a building wall 7. However, it is to be understood that the structural member 2 may be bonded directly to the steel deck 10 at the inward portion 13 of the lower surface 5. Furthermore, for roof constructions having a steel deck that extends substantially to the outer surface 14 of the building wall 7, the structural member 2 is bonded solely to the steel deck, or other roof structure. Because the structural member 2 is structurally bonded directly to the building wall 7 and/or steel deck 10, a wood block nailer structure is not required. Furthermore, because there is no applied external fascia strip or flashing, a wood block nailer structure and cant strip are not required, because no mechanical fasteners are required to secure fascia strips or flashing. Accordingly, the structural termination system 1 of the present invention eliminates the numerous components, including wood block nailer and wood cant strips, as well as eliminating the external flashing and fascia members. Furthermore, the need for extensive, time consuming installation of mechanical fasteners is likewise eliminated. Finally, elimination of mechanical fasteners along the extrusion 2 eliminates penetrations, thereby improving the waterproofing of the roof structure.

The elongated structural member 2 includes an inner wall 15, and an upper wall 16. Roof layer or membrane 12 extends over the upper wall 16, and is securely bonded thereto, forming a waterproof seal along the perimeter of the roof layer 12. Roof layer 12 is preferably bonded to structural member 2 using an M1 Structural Sealant available for CHEM LINK Corporation of Kalamazoo, Mich. The adhesive has sufficiently strong adhesion to provide the sole means for securing the perimeter of roof layer 12, thereby eliminating the need to provide additional mechanical fasteners, fascia strips, and the like. Upper wall 16 of structural member 2 may extend inwardly to form an insulation retaining flange 17 that fits over the edge of the insulation 11, thereby retaining the edge of the insulation 11. The elongated structural member further includes an upwardly extending upper wall portion 18 which terminates at an upper edge 19, where the upwardly-extending portion 18 joins with the outer wall 3. The upper portion 20 of the outer wall 3 and the outward portion 21 of the upper wall 16, and the upwardly-extending portion 18 together define an integral gravel stop 22 having a triangular cross-sectional shape. The gravel stop 22 is utilized to retain the loose-laid ballast, or gravel on built-up roofing systems.

The outer wall 3, inner wall 15, upper wall 16, and lower, or horizontal wall 4 define a rectangular perimeter. A web 23 extends vertically across the rectangular perimeter to define a pair of side-by-side rectangular passages 24 and 25. The web 23 provides additional structure to strengthen and/or rigidify the structural member 2 such that the structural member 2 can withstand the forces generated by wind.

The elongated structural member 2 is adhesively bonded directly to the steel deck 10 and/or wall 7 by a waterproof adhesive that preferably has at least 100 pounds per square inch (psi) sheer strength, with higher strength adhesives of at least 200 psi also being preferred to provide a secure adhesive bond. In a preferred embodiment, lower surface 5 has a width "W" (FIG. 1) of at least 4.0 inches, thereby providing at least 4800 pounds of shear strength per linear foot of structural member or extrusion 2. If the shear strength of the adhesive is higher or lower than 100 psi, the width "W" of the lower surface 5 of structural member 2 can be varied to provide the desired 4800 pounds per linear foot bond strength. Although lower strength systems may be adequate for a given application, it is presently preferred that the termination system have at least 3500 to 4800 pounds per linear foot of tensile strength to provide additional strength. Width "W" can be increased if higher strength is required, and, the shear strength of the adhesive may also be increased if higher strength is required, such as for buildings in geographic areas experiencing high wind velocities. In the first embodiment, the adhesive is preferably a thermo-setting elastomeric adhesive to accommodate the dimensional changes of the elongated structural member 2 caused by temperature changes. Because building walls and roofs are typically constructed from materials such as concrete, masonry blocks, or steel, the building structure will have a to substantially lower co-efficient of thermal expansion than the aluminum extrusion. This difference in the coefficients of thermal expansion causes stresses on the adhesive due to temperature changes, such that a flexible, elastomeric adhesive material is required. Furthermore, the adhesive preferably maintains its flexibility and bond strength in a temperature range of −20° F. to 180° F.

Figure 2:
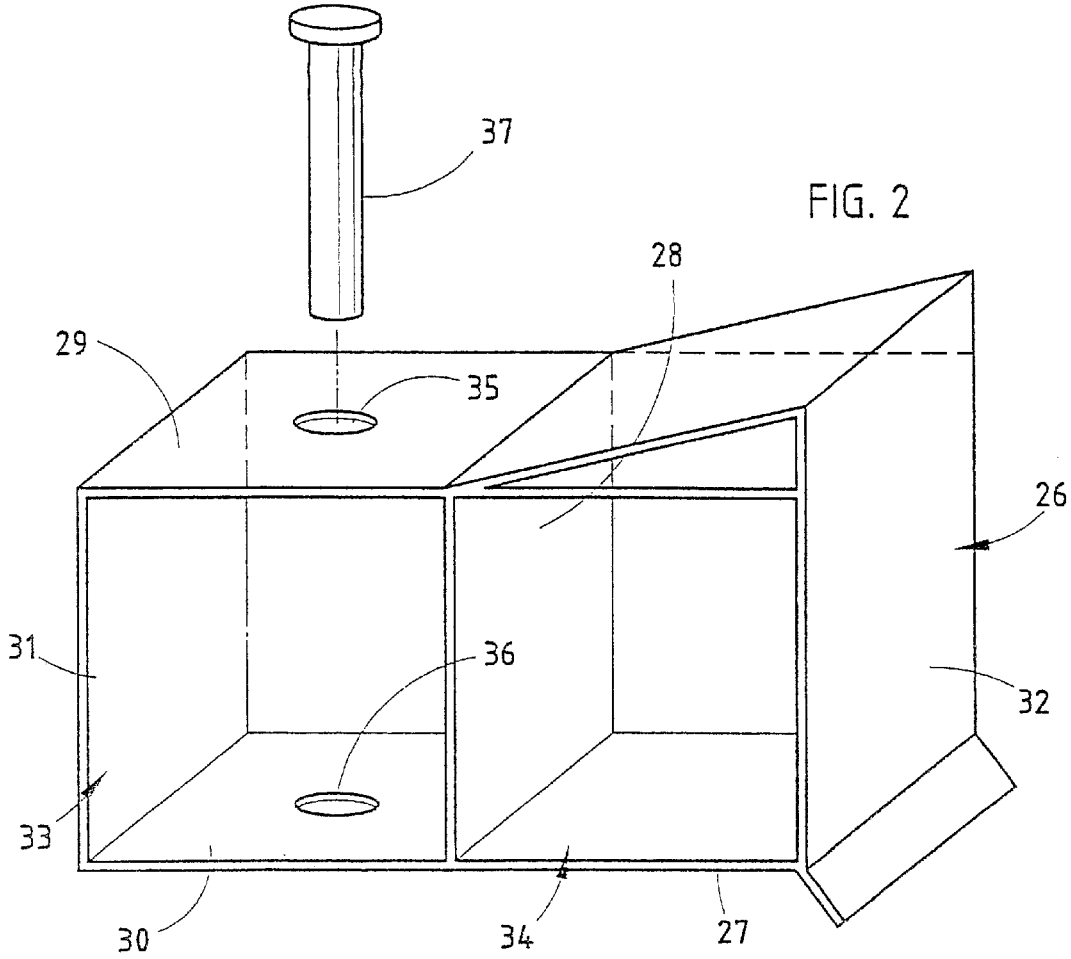
FIG. 2 is a perspective view of the joint member.
Figure 3:
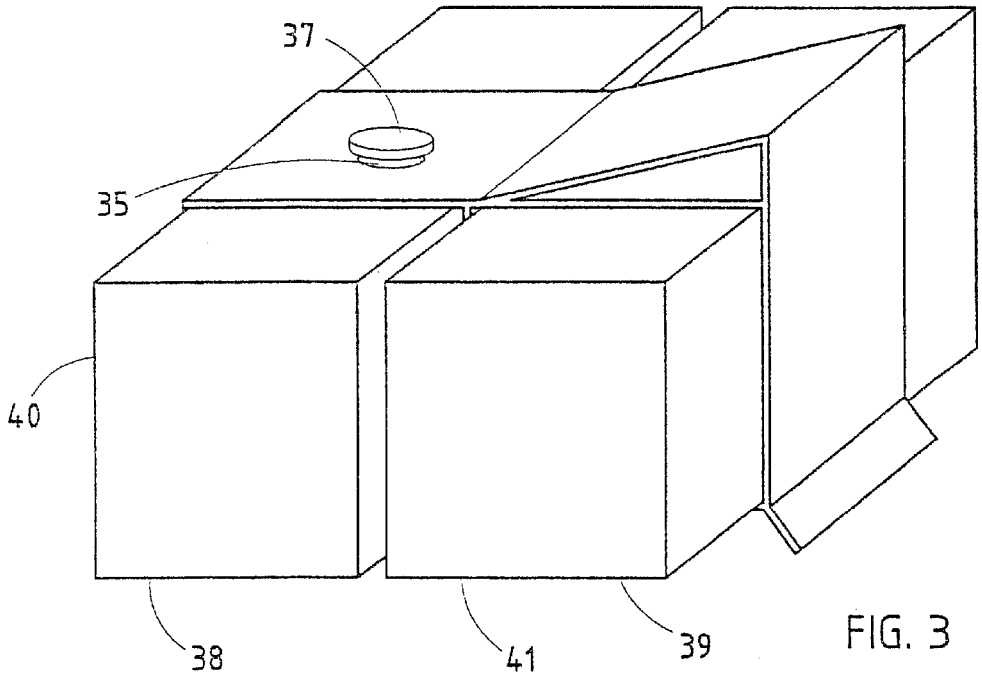
FIG. 3 is a perspective view of the joint member with the polyurethane joint blocks in the installed position.

With reference to FIGS. 2 and 3, a joint member 26 has upper and lower walls 29, 30 and inner and outer walls 31, 32 that define a rectangular perimeter 27 corresponding to the rectangular portion of the elongated structural member 2. A web 28 extends generally vertically between the upper and lower walls 29 and 30 to define a pair of side-by-side rectangular passages 33 and 34. Clearance holes 35 and 36 are provided in upper and lower walls 29 and 30, respectively. A conventional anchor bolt 37 is utilized to anchor the joint member 26 to the building wall and/or roof deck. To install joint member 26 to buildings having a concrete roof deck, anchor bolt 37 is embedded into the structural substrate of the concrete roof deck. Alternatively, anchor bolt 37 is tapped into a structural steel member and/or a bar joist when joint member 26 is installed on a steel deck roof. Anchor bolt 37 secures the joint member 26 and structural member 2 to secure the termination assembly while the adhesive is curing, thereby permitting further assembly of roof components. Anchor bolts 37 also provide additional strength to retain the termination system. A pair of polyurethane blocks 38 and 39 (FIG. 3) are snugly received within the rectangular passages 33 and 34. The polyurethane blocks 38 and 39 have rectangular perimeters 40 and 41, respectively that correspond closely to the rectangular passages 24 and 25 of structural member 2, thereby securing structural member 2 to joint member 26.

At the corners of the roof (not shown), the structural member 2 is diagonally cut, or mitered such as at a 45° angle. A pair of relatively short angle-cut pieces are then welded or otherwise joined along the mitered cut edge to form a corner piece having the same cross-sectional shape as elongated structural member 2. A joint member 26 is used to connect the corner piece to the adjacent elongated, straight structural members 2.

During installation of the first embodiment of the structural termination system just described, structural adhesive 9, a two-part, flexible adhesive such as a "Flash Pack" adhesive, manufactured by CHEM LINK Corporation, Kalamazoo, Mich. is applied to the lower surface 5 of the structural member 2. The adhesive 9 is preferably applied along the entire lower surface of extrusion 2 and joint member 26 to provide a wind and waterproof seal around the entire perimeter of the roof surface or membrane. This arrangement prevents air from being forced under the membrane which would result in pressurization of the air under the roof surface or membrane. Preventing pressurization of air under the roof surface or membrane substantially reduces the tendency of the roof surface to blow off, a condition wherein the roof surface layer "balloons" upwardly, causing the edge of the roof membrane to detach, resulting in catastrophic failure. Prior roof edge systems utilizing wood nailer members may further aggravate this problem due to the tendency of the wood nailer loosen, resulting in air entering under the wood nailer, further contributing to pressurization and blow off of the roof system. Alternatively, the structural adhesive 9 may be applied to the upper surface 6 of the building wall 7 and/or the upper surface of the steel deck 10. The structural member 2 is then placed directly on top of the building wall 7 and/or the steel deck 10. The inner edge 42 of the insulation 11 is positioned under the insulation retaining flange 17, and the roofing membrane or membranes 12 are bonded to the upper wall 16 and the upwardly extending portion 18 of the structural member 2. At the joints, polyurethane blocks 38 and 39 are inserted into the rectangular passages 24 and 25, and may be adhesively bonded utilizing structural adhesive 9. Anchor bolts 37 are secured to the building wall and/or steel deck 10 at each joint 26.

Figure 4:
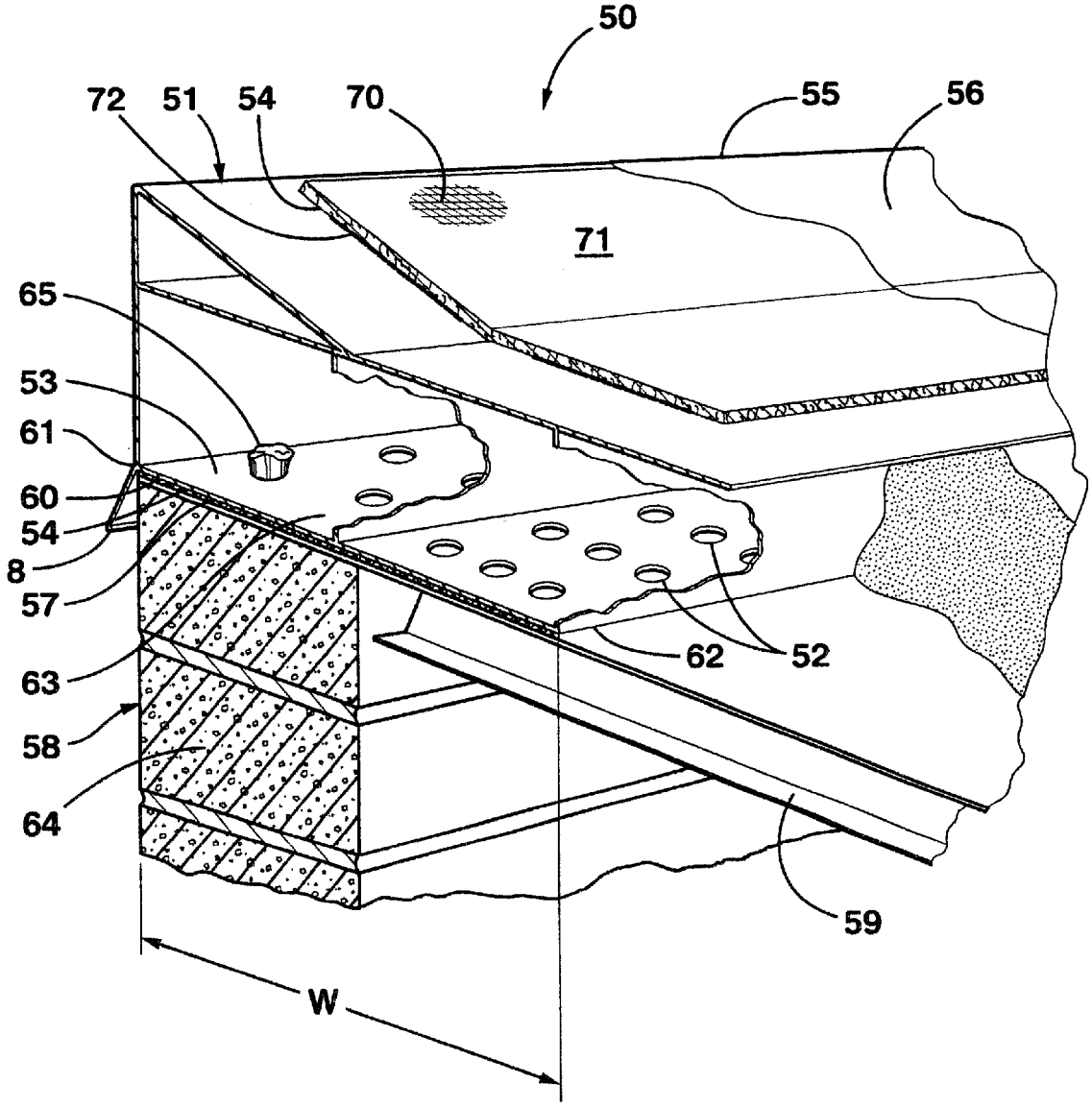
FIG. 4 is a cross-sectional perspective view of a second embodiment of the termination system, wherein the extrusion includes perforations in a lower web that expose moisture-curing adhesive to ambient moisture for curing of the adhesive.

A second embodiment of the structural termination system 50 is illustrated in FIG. 4. The structural termination system 50 secures the perimeter of the roof membrane 56 to the upper surface 57 of the building 58 proximate the roof 59 of the building 58. Structural termination system 50 includes an elongated structural member 51 such as an aluminum extrusion having a generally horizontal lower web or wall 53 defining a lower surface 60 that is shaped to fit closely along the upper surface 57 of the building 58. The lower surface 60 includes edge portions 61 and 62. The lower web 53 has a plurality of perforations 52 therethrough, and moisture curing adhesive 54 is disposed on the lower surface 60. The moisture curing adhesive is also disposed adjacent at least one of the perforations 52, such that the moisture curing adhesive 54 cures in an area 63 of the lower web 53 that is spaced apart from the side edges 61 and 62 of the lower surface 60.

Figure 1A:
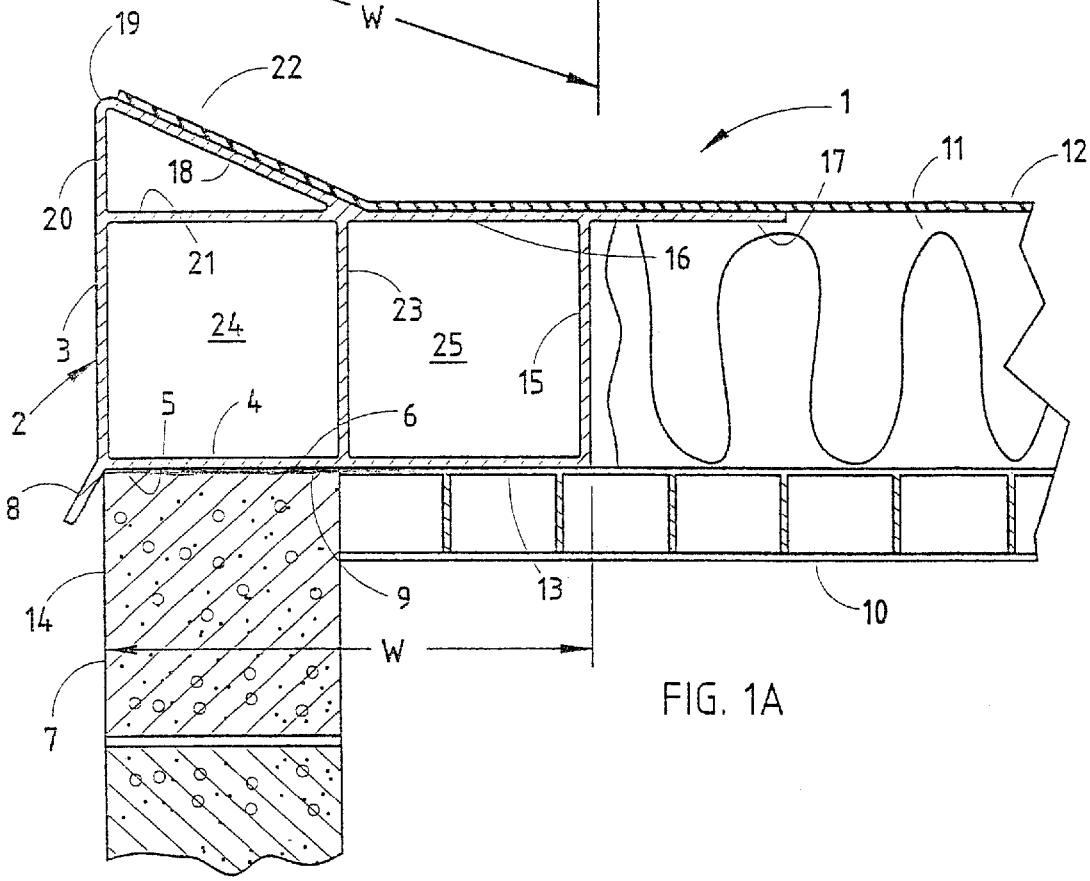
FIG. 1A is a cross-sectional view of the structural termination system.

The extrusion 51 illustrated in FIG. 4 is substantially the same as the structural member 2 illustrated in FIGS. 1 and 1A, except that a plurality of perforations 52 in the lower web 53 are provided to expose the moisture curing adhesive 54 to ambient moisture. In addition, extrusion 51 does not include a retaining flange 17. The moisture curing adhesive 54 is disposed along the lower surface 60 of the extrusion, and bonds the extrusion 51 to the roof 59 and/or building wall 64. During installation, the adhesive 54 will normally be pushed upwardly through the perforations shown at 65. However, for purposes of the present illustration, the adhesive 54 is not shown "pushed up" in FIG. 4, except at 65. Although the size of the perforations 52 is not critical, in the preferred embodiment the perforations 52 have a diameter of about 0.3125 inches.

To form a weathertight envelope over the edge of a commercial building, roof membranes must be firmly and permanently secured to the perimeter of the structure. According to the present invention, this attachment is achieved by adhesive bonding that is chemically appropriate and specific to each of the three types of roof membrane systems described herein. The moisture curing adhesive 54 is preferably a M-1 Structural Sealant, available from CHEM LINK Corporation, Kalamazoo, Mich. 49007. Suitable adhesives, such as the M-1 Structural Sealant, preferably have a sheer strength of at least 100 pounds per square inch ("psi") and more preferably 300 psi or more after an appropriate moisture cure.

The adhesive also has an elongation at break of at least 100% to 150%, and most preferably 300% elongation, also after an appropriate cure. Extrusion 51 and the building wall 64 and building roof 59 often have different coefficients of expansion, such that the extrusion 51 will expand and contract at a different rate than the building wall 64 and roof 59 as the temperature fluctuates. Accordingly, the moisture curing adhesive 54 has sufficient flex and/or stretch properties to permit expansion and contraction of the extrusion 51 relative to wall 64 and/or roof 59, while maintaining a water and airtight seal and also forming a strong structural bond to the building wall 64 and/or roof 59. In general, the adhesive should have the following attributes: (1) adhesion to anodized aluminum; (2) adhesion to bituminous materials, thermosetting (EPDM) rubber membrane, and thermoplastic ("PVC") membrane; (3) the adhesive is preferably thermosetting and resistant to deformation under load at temperatures as high as 200° F.; (4) the adhesive is preferably elastomeric and capable of accommodating stress at temperatures as low as −40° F.; and (5) the adhesive is preferably permanent and resistant to heat, moisture, and oxidation for more than twenty years.

One adhesive that meets these criteria is described in the following two component adhesive formulation described in parts by weight:

| Component A | |
|---|---|
| Siloxane terminated polyether (Kaneka Silyl) | 100 parts |
| polyamine (DES 24 Dow) | 5 parts |
| silane adhesion promoter (A-1120). | 2 parts |
| hindered phenol antixoidant (cyanamid 2246) | 3 parts |
| subtotal | 120 parts |

| Component B | |
|---|---|
| bisphenol a epoxy resin (Shell Epon 828) | 50 parts |
| organotin catalyst (Kanek U220) | 2 parts |
| water | 0.5 parts |
| subtotal | 52.5 parts |

The adhesive is mixed in the above proportions and applied to the upper metal surface of extrusion 2 at a rate of spread of not less than 150 square feet to the gallon (10 mils). The membrane is pressed into place and allowed to cure for one hour before load is applied. However, this two part bonding technique is often difficult to conduct under field installation conditions. To eliminate the two part bonding during installation, an elongated strip of facing material 70 (FIG. 4) of an appropriate material matching the roof layer of a particular roof system can be installed on the upper surface of the roof edge extrusion 2, and bonded under factory conditions prior to shipping to the installation site. The facing material 70 can then be secured to a compatible roof membrane 12 under field conditions using known field bonding techniques consistent with construction of each membrane class. These known bonding techniques are typically used to bond sheets of like roofing layers together along seams of adjacent sheets of the roofing layer.

For example, bituminous roofing can be secured to a preapplied bituminous facing material 70 by fusing the surfaces together with heat or flame. A thermoplastic "PVC" membrane can be fused to a PVC facing material 70 with a heat gun. Thermoset EPDM membrane can be chemically bonded to EPDM facing material 70 with solvent based contact bond splice adhesive commonly used in the industry along seams in the membrane.

Elongated strip 70 may also be a sheet of heat sealable material including a felt lower layer 72 that is bonded to the extrusion 51 by moisture curing adhesive 54, or other suitable adhesive. In this example, heat sealable facing sheet 70 has an upper layer 71 that is heat sealable, and roof membrane 56 is also heat sealable. As described above, facing sheet 70 may be adhesively bonded to extrusion 51 prior to transport to the installation site. At the installation site, the extrusion 51 is then adhesively bonded to the building 58, and heat is applied to the roof membrane 56 and/or facing sheet 70, thereby forming a water tight, secure bond between the roof membrane 56 and facing sheet 70. In this example, facing sheet 70 is a G410 roofing membrane, with a 48 mil. upper layer 71, and 18 ounce felt lower layer 72, and is available from Sarnafil, Inc., Canton, Mass. 02021. The felt lower layer 72 is glass fiber, and forms a strong bond to the extrusion 51 by means of the moisture curing adhesive 54. Although a moisture curing adhesive 54 is presently preferred for bonding facing sheet 70 to the extrusion 51, it is anticipated that other types of adhesives could be used for this purpose.

During installation, the extrusion 51 is cut to the proper length if required, and the moisture curing adhesive 54 is applied to the upper surface 57 of building 58 and/or the lower surface 60 of the extrusion 51. The extrusion 51 is then positioned on the roof 59 and/or building wall 64. The extrusion 51 is then pressed downwardly, causing the adhesive 54 to "extrude" upwardly through the perforations 52 as designated 65 in FIG. 4. The ambient moisture is thus exposed to the adhesive 54, and a sufficient time period for curing of the adhesive 54 is permitted prior to the remaining steps of the installation process. After the adhesive 54 has obtained a sufficient cure, the roof membrane 56 is placed on the roof, and the roof membrane 56 to securely bonded to the facing sheet 70 utilizing an appropriate one of the bonding techniques described above, depending upon which of the three types of roofing material is being used, forming a waterproof seal around the perimeter of the roof. Alternately, if a facing sheet 70 is not provided on the extrusion 51, the roof membrane 56 may be adhesively bonded to the extrusion 51 using moisture curing adhesive 54. Extrusion 51 is connected end-to-end with adjacent extrusions 51 by a joint member such as the joint member 26 and blocks 38 and 39 discussed above. The corners (not shown) are angle cut and welded, also as discussed above.

The structural termination system of the present invention eliminates separate external fascia members of conventional which are prone to wind failure, and also eliminates the wood nailer and wood cant structures which are normally custom-fitted and installed to support the flashing and fascia strips. Furthermore, the extensive use of mechanical fasteners is substantially eliminated, thereby substantially reducing the required labor and associated expenses encountered with conventional wood block roof edge attachment arrangements.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is as follows:

1. A roofing system for securing the perimeter of a waterproof roof layer to the upper surface of a building proximate the roof of the building, comprising:

a waterproof roof layer;

a unitary, one-piece tubular elongated structural member defining opposite ends and an intermediate portion therebetween, said structural member having a continuous outer perimeter defining an elongated cavity and a generally horizontal lower web with a lower surface shaped to fit closely along the upper surface of a building, said lower web having a plurality of perforations therethrough to said elongated cavity, at least one of which is located in said intermediate portion of said structural member; said elongated structural member including an integrally formed flange extending downwardly below said lower surface of said lower web to define an integral drip edge; said elongated structural member having a cross-sectional shape including a generally vertical medial wall defining a pair of side-by-side passages;

moisture curing adhesive disposed on said lower surface and extending substantially uninterrupted along the entire length of the structural member to form a seal along the entire structural member when installed on an upper surface of a building, said waterproof roof layer adhesively bonded to said structural member without mechanical fasteners, a portion of said adhesive disposed within at least one of said perforations.

2. A roofing system as set forth in claim 1, including:

a preformed sheet of facing material adhesively bonded to said elongated structural member with the waterproof roof layer sealingly bonded to the facing material on said structural member during installation.

3. A structural termination system as set forth in claim 2, wherein:

said sheet of facing material includes a layer of heat sealable polymer.

* * * * *